US009309477B2

(12) United States Patent
Foss-Smith

(10) Patent No.: US 9,309,477 B2
(45) Date of Patent: Apr. 12, 2016

(54) SYSTEM FOR REMOVING SURFACE MOISTURE FROM COAL

(75) Inventor: Patrick Foss-Smith, Dorset (GB)

(73) Assignee: COOMTECH LTD., Pewsey, Whiltshire (GB)

( * ) Notice: Subject to any disclaimer, the term of this patent is extended or adjusted under 35 U.S.C. 154(b) by 208 days.

(21) Appl. No.: 14/240,841

(22) PCT Filed: Mar. 29, 2012

(86) PCT No.: PCT/GB2012/000348
§ 371 (c)(1),
(2), (4) Date: Feb. 25, 2014

(87) PCT Pub. No.: WO2012/160320
PCT Pub. Date: Nov. 29, 2012

(65) Prior Publication Data

US 2014/0325867 A1 Nov. 6, 2014

(30) Foreign Application Priority Data

May 24, 2011 (GB) ..... 1108728.5

(51) Int. Cl.
*F26B 5/02* (2006.01)
*C10L 5/04* (2006.01)
(Continued)

(52) U.S. Cl.
CPC ... *C10L 5/04* (2013.01); *F23K 1/00* (2013.01); *F26B 5/02* (2013.01); *F26B 17/107* (2013.01); *F26B 21/001* (2013.01); *F23K 2201/20* (2013.01); *F23K 2201/30* (2013.01)

(58) Field of Classification Search
CPC ..... F26B 5/00; F26B 5/02; F26B 21/00; F26B 21/001; B03C 7/00; B03C 7/04; F23B 7/00; F23G 7/00; B01J 8/00; B01J 8/18
USPC ..... 34/279, 443, 218; 209/127.1; 110/204, 110/243, 341
See application file for complete search history.

(56) References Cited

U.S. PATENT DOCUMENTS 1,456,392 A * 5/1923 Marshall ..... 432/110
2,666,269 A * 1/1954 Parry ..... 34/363
(Continued)

FOREIGN PATENT DOCUMENTS

CH 261896 A 6/1949
FR 2449257 A1 9/1980
(Continued)

OTHER PUBLICATIONS

Communication pursuant to Article 94(3) EPC for European Application No. 12720255.4 dated Oct. 20, 2014.
(Continued)

*Primary Examiner* — Stephen M Gravini
(74) *Attorney, Agent, or Firm* — Patterson & Sheridan, LLP

(57) ABSTRACT

This invention provides a system for removing surface moisture from granulated coal or other materials in particulate form, the system comprising a dryer, wherein the dryer has: an in-feed (1) for material particles; an in-feed (3) for entrainment gas (suitably air) to provide dilute phase gas entrainment of the particles; and turbulence—inducing means (5) configured to subject the flow of gas-entrained particles to turbulence to strip water from the surface of the entrained particles. The system is highly efficient and economical to operate, requiring no external heat input and yet achieving a high drying effectiveness.

21 Claims, 2 Drawing Sheets

(51) Int. Cl.

| | |
|---|---|
| ***F23K 1/00*** | (2006.01) |
| ***F26B 17/10*** | (2006.01) |
| ***F26B 21/00*** | (2006.01) |

(56) References Cited

U.S. PATENT DOCUMENTS

| | | | | | |
|---|---|---|---|---|---|
| 2,924,887 | A | | 2/1960 | Marshall et al. | |
| 3,632,257 | A | * | 1/1972 | Ashizawa | 425/222 |
| 3,766,661 | A | * | 10/1973 | Bayens et al. | 34/371 |
| 3,780,447 | A | * | 12/1973 | Fales | 34/136 |
| 3,851,404 | A | | 12/1974 | Fracke et al. | |
| 4,057,908 | A | * | 11/1977 | Mirliss et al. | 34/360 |
| 4,101,263 | A | * | 7/1978 | Lumpkin, Jr. | 432/13 |
| 4,341,530 | A | | 7/1982 | Loth et al. | |
| 4,945,657 | A | * | 8/1990 | Shinn et al. | 34/128 |
| 5,791,066 | A | * | 8/1998 | Crews | 34/168 |
| 6,108,935 | A | * | 8/2000 | Dodson | 34/364 |
| 6,158,145 | A | | 12/2000 | Landon et al. | |
| 6,249,988 | B1 | * | 6/2001 | Duske et al. | 34/62 |
| 7,155,841 | B2 | * | 1/2007 | Livingston | 34/136 |
| 7,380,348 | B2 | * | 6/2008 | Seebach | 34/326 |
| 8,533,971 | B2 | * | 9/2013 | Hubbard et al. | 34/80 |
| 8,726,532 | B2 | * | 5/2014 | Hogan | 34/141 |
| 8,832,964 | B2 | * | 9/2014 | Foxen | 34/396 |
| 2006/0213075 | A1 | | 9/2006 | Livingston | |
| 2012/0241405 | A1 | | 9/2012 | Lobbestael et al. | |
| 2013/0243896 | A1 | | 9/2013 | Lobbestael et al. | |
| 2013/0270215 | A1 | | 10/2013 | Lobbestael et al. | |
| 2014/0325867 | A1 | * | 11/2014 | Foss-Smith | 34/279 |

FOREIGN PATENT DOCUMENTS

| | | | | |
|---|---|---|---|---|
| GB | 647657 | | | 12/1950 |
| GB | 1059471 | A | | 2/1967 |
| GB | 2099969 | A | | 12/1982 |
| SU | 1753218 | A1 | | 8/1992 |
| WO | 03092902 | A1 | | 11/2003 |
| WO | WO 2012/160332 | | * | 11/2012 |

OTHER PUBLICATIONS

International Search Report for PCT/GB2012/000348, mailed Nov. 13, 2012.

GB Search Report for GB1108728.5, performed Jun. 29, 2011.

* cited by examiner

SYSTEM FOR REMOVING SURFACE MOISTURE FROM COAL

FIELD OF THE INVENTION

The present invention concerns a system (method and apparatus) for removing moisture, in particular surface moisture, from coal or other solid particulate materials. The system particularly suits drying of brown coal but may also suit other solid fuels and particulate materials.

BACKGROUND TO THE INVENTION

Water is one of several nuisance contaminants in coal that affect its value since the presence of water leads to increased transport costs and a reduction in the calorific value of the coal resulting in higher fuel consumption per unit of output. In a coal fired power station, for example, the coal is traditionally dried within the combustion space during firing and the heat needed to dry the coal and enable progress towards its ignition temperature is not available for steam generation and is wasted.

The moisture content of coal falls into two broad types: inherent moisture and surface moisture. The inherent or internal moisture of coal is water in micro-pores and micro-capillaries within coal particles that was deposited within the coal during the coal's formation. Surface adsorption moisture of coal is water that forms a layer only on the surfaces of the coal particles. Reduction of both types of moisture is traditionally undertaken using heat delivered in the boiler or, less commonly, in an external dryer. The surface moisture is largely removed by the application of heat, alone or with mechanical pressure, reducing the coal moisture content from as high as, say, 60% down to more moderate levels of the order of 30%. An example of one such brown coal thermal drying and milling process is described in European patent EP 0579214.

The heat required to remove surface moisture by thermal drying is significant and therefore non-thermal methods of drying are welcome. Benefits of non-thermal methods of drying include reductions in fuel consumption and may include reductions in atmospheric emissions of harmful pollutants, including Sulphur Dioxide, Carbon Dioxide, Chlorine, Mercury and others. It is, inter alia, an object of the present invention to s provide a new system suitable for efficient and cost-efficient drying of brown coal or other carbonaceous solid fuel materials to substantially remove surface moisture in a non-thermal manner, i.e. substantially without applying heat energy to the material.

SUMMARY OF THE INVENTION

According to a first aspect of the present invention there is provided a system for removing surface moisture from granulated coal or other materials in particulate form, the system comprising a dryer, wherein the dryer has: an in-feed for material particles; an in-feed for entrainment gas(es), to provide dilute phase gas entrainment of the particles; and turbulence-inducing means configured to subject the flow of gas-entrained particles to turbulence, wherein the turbulence-inducing means comprises a supply of dry gas(es) in use and that delivers the dry gas(es) so as to impinge on/intersect with the gas-entrained particle flow whereby inducing turbulence to strip water from the surface of the entrained particles.

The system of the present invention enables economic and highly efficient drying of coal or other materials in finely divided granular/particulate form. The system comprises a turbulent flow gas (air) entrainment drier apparatus that strips surface moisture off the particles by varying the acceleration and speed of the airflow. The particles entrained in the airflow possess inertia which prevents each particle from achieving the same velocity as the entrainment air. The relative velocity of material to air, known as the slippage ratio, is around 0.8. Whilst each particle accelerates to nearly match the free air velocity the entrainment air flows around the particle thereby presenting the force necessary for acceleration. It is the momentary speed differential which produces the shear force necessary to strip water from the particle surface. Undesirable laminar flow conditions are discouraged within the drying zone of the drier but are encouraged within the other areas of the apparatus to reduce apparatus erosion and particle attrition.

Preferably the dryer comprises a rotor within a stator body (or casing), the stator body having the form of a tubular main duct through which the air-entrained particles flow in use. In some embodiments the stator may be laterally offset relative to the rotor, having the longitudinal axis of the stator offset and parallel to the axis of the rotor.

The turbulence-inducing means particularly preferably comprises at least one port—suitably an array of ports (preferably as nozzles)—in the stator body to deliver high velocity compressed/pressurised turbulence-inducing gas(es) inwardly into the main duct to intersect with the air-entrained particle flow. The one or more ports preferably deliver the turbulence-inducing gas(es) substantially directly radially inwardly towards the rotor axis and substantially orthogonal to the air-entrained particle flow. The array of ports in the stator body is suitably arranged in multiple rings around the rotor—preferably spaced at regular intervals around the rotor.

The rotor particularly preferably has a tubular duct therethrough and at least one port and suitably an array of ports (preferably as nozzles) to deliver high velocity compressed/pressurised gas(es) outwardly into the main duct to impinge on the gas-entrained particle flow. Particularly preferably the one or more ports are configured to deliver the high velocity compressed/pressurised gas(es) outwardly tangentially to the rotor whereby it energises rotation of the air-entrained particle flow. The array of ports of the rotor is suitably arranged in a ring,—with the ports preferably spaced at regular intervals around the rotor. Preferably there are multiple rings around the rotor at intervals along its length.

The dryer is configured to operate to rotate the air-entrained particle flow as it passes therethrough and the array of outlets/nozzles of the rotor assist this rotation.

Preferably the in-feed for the material particles comprises an in-feed auger. Preferably the rotor is integral with or coupled to the particulate material in-feed auger to rotate therewith. Suitably the rotor-with-auger is a quill drive hollow flight auger.

In another embodiment the material particles infeed may comprise, instead of an infeed auger, a venturi educator whereby the particles are drawn into the throat of the venturi and thence into the main duct of the dryer by the entrainment air.

Turning to the entrainment gas in-feed, this preferably comprises one or more ports that are substantially tangential to the rotor or longitudinal axis of the dryer whereby rotation of the flow through the dryer is initiated.

The dryer entrains coal particles in a stream of air whilst subjecting the particles to turbulent air flow, imposing a substantially constant mismatch in the relative air-to-particle velocity thereby encouraging the surface water to adopt the same velocity as the air flow rather than the velocity of the host coal particle. In this way water is stripped from the surface of the particle. The invention can be efficiently applied to other granular materials exemplified by sand, abrasive water-jet cutting compounds, sawdust, flour and others.

Preferably the main duct of the dryer through which the gas-entrained particles flows has, proximate the in-feed end, a throat to cause an increase in flow velocity and drop in pressure with a corresponding velocity differential between the entrainment air and entrained particles to induce stripping of water. The main duct of the dryer exiting the throat preferably broadens to a greater cross sectional area and a larger diameter than the throat, slowing flow and inducing a momentary velocity differential between the entrainment air and entrained particles resulting in further shearing.

According to a second aspect of the present invention there is provided a process for removing surface moisture from granulated coal or other materials in particulate form, the process comprising feeding the material particles and entrainment gas(es) into a duct to provide dilute phase gas entrainment of the particles and introducing dry gas(es) to impinge on the flow of gas-entrained particles to cause turbulence in the flow of gas-entrained particles to strip water from the surface of the entrained particles.

The system and process avoid use of heat application for the drying but Uses a dry gas or mixture of gasses such as low pressure compressed air that is suitably delivered at, or near, atmospheric temperature and at, or below, its Dew Point avoiding water vapour droplets and serving to cause is turbulence in the flow of gas-entrained particles. Steam is of course not viable for this purpose since it will continuously re-wet the particles and frustrates the whole purpose of the process. For substantially all practical purposes the dry gas or mixture of gases such as air is delivered with Relative Humidity of less than 99% and in most cases below 95% and even below 85% or 80%.

Preferably the compressed air is delivered from a high volume source exemplified by a rotary lobe blower, liquid ring compressor, rotary vane compressor or similar. The invention can be installed as a complementary addition to, or as a replacement of an existing air conveying system.

In one embodiment the entrainment air may be supplied as an induced draught. In this embodiment the entrainment air could be wholly or partially induced by power station forced draught fan inlets. The airflow rate is suitably of the order of 20 meters per second or from 10 to 30 meters per second. The impinging air to create turbulence for surface moisture stripping may be delivered into the plenum of the stator chamber without destroying the partial vacuum of the induced draught system. Advantages of this approach include flash evaporation of surface water due to the sudden pressure drop. Another advantage is that once the coal/moisture has been separated from the airflow the air would be drawn through the main blower (rotary lobe, liquid ring, vane type, etc) and become available to the plant for other purposes, for instance combustion air of for a fluidised bed.

The apparatus may be simply fabricated from steel, aluminium or other similar readily formable common industrial materials and can be located 'in the field'. Preferably the location of the equipment is at, or close to, the point of use to reduce re-absorption of water. In the context of coal or other solid fuels by this we mean that the dryer is at the power plant for burning the fuel substantially directly rather than needing to store and transport it.

The equipment allows the treated coal and water to be separately discharged. The water discharge, in the form of vapour and droplets, may be filtered to retrieve residual coal particles and to minimise fugitive emissions to the atmosphere. The out-feed of the apparatus is mainly comprised of coal, water vapour, water droplets and air. The out-feed can be handled in a number of ways by the end user using commonly available equipment. For example it may be subjected to a cyclone, bag filtration or direct combustion within a pulverised fuel boiler and others. Out-flowing gas(es) from the dryer may be recycled, eg admixed with the inflowing transport gas(es) or even the impinging gas(es), but prior to this will generally be treated first to reduce moisture content/remove water vapour/droplets before being re-used. The moisture reduction may occur at an airlock.

The scale of the apparatus can be increased or decreased to suit very small throughputs or very large throughputs and is preferably modular, with multiple drying stages suitably arranged into serial arrays to achieve the desired final moisture content.

The efficiency and effectiveness of the apparatus and process is such that the no heat needs to be introduced for the drying. The system may generate some adiabatic heat energy from the gas flow/airflow in operation as a forced draft system rather than as an induced draft system but there is no requirement to pre-heat fluids, or use combustion, electrical heating or any other heating means to enable the drying.

According to a further aspect of the present invention there is provided a system for removing surface moisture from granulated coal or other materials in particulate form, the system comprising a dryer, wherein the dryer has: an in-feed for material particles; an in-feed for entrainment gas(es), to provide dilute phase gas entrainment of the particles; and turbulence-inducing means configured to subject the flow of gas-entrained particles to turbulence to strip water from the surface of the entrained particles.

In any of the aspects of the invention a preferred further feature is provision of an ultrasound generator. This is suitably an annular contact probe that encircles the stator body in contact therewith. The ultrasound generator is arranged to deter contact between the coal particles and the inner chamber wall of the stator casing and to further disrupt the flight of coal particles, increasing stripping of surface moisture from the coal particles.

In any of the aspects of the invention a preferred further feature is provision of a generator of low frequency sound below 20 kHz or infrasound, preferably, wherein the low frequency sound or infrasound generator is configured to apply sound waves to material particles where they meet the entrainment gas(es). The low frequency sound or infrasound generator is suitably positioned to direct sound waves towards the exit of the in-feed auger and preferably comprises a diaphragm that is driven by compressed air.

BRIEF DESCRIPTION OF THE DRAWINGS

A preferred embodiment of the present invention will now be more particularly described, by way of example only, with reference to the accompanying drawings, in which.

DESCRIPTION OF THE PREFERRED EMBODIMENT

Figures 1, 2A, 2B, 3:
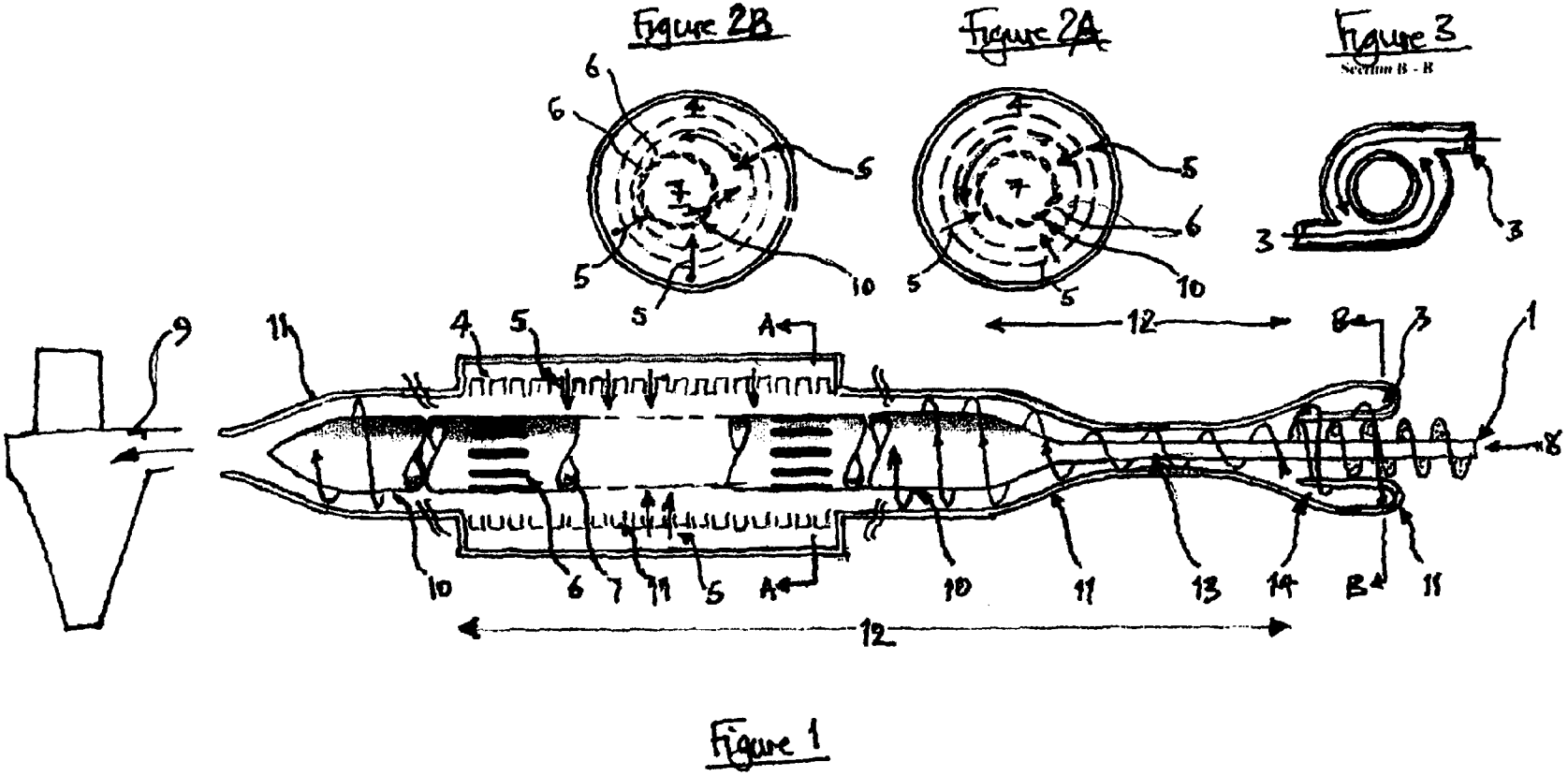
FIG. 1 is a schematic diagram of the system for removing surface moisture from granulated coal.
FIG. 2A is a transverse section through the dryer, taken along the line A-A in FIG. 1 and showing a configuration in which the rotor is substantially centrally aligned within the dryer body/casing.
FIG. 2B is a transverse section through the dryer, taken along the line A-A in FIG. 1 but showing a variant configuration in which the rotor is offset from the central longitudinal axis of the dryer body/ stator.
FIG. 3 is a transverse section through the dryer, taken along the line B-B in FIG. 1 and showing the tangential entrainment air in-feed.

Referring to FIG. 1, particulate/granulated feedstock, such as granulated coal, is received ready for processing in a feed hopper (not shown) of the dryer. The feed hopper has a discharge auger separate from or coupled to an in-feed auger 1 of the dryer.

In operation, the particulate coal is drawn into the dryer by entrainment air, at a pressure that is typically of around 1 bar, and becomes airborne with a velocity of around 15-30 m/s. A typical air : coal mass ratio for effective dilute phase air entrainment of the coal is of the order of 2:1. The apparatus is arranged to encourage the entrainment air to follow a high velocity helical path therethrough. Residence time in the dryer to effect the required level of drying of the coal can be suitably engineered by adjusting the length of the apparatus or by installing multiple serial units of the apparatus. The dryer is arranged so that during the passage through the apparatus, the entrainment air flow carrying the coal particles is transected by turbulence inducing air to induce a high level of turbulence and an air-particle velocity differential that produces shear forces at the surface of each particle, stripping the surface water free from the particles. The downstream zone of the dryer apparatus is configured so that once the water has been stripped away turbulence is minimised and the air-water-particle stream is allowed to achieve nearly the same terminal velocity, near the point of discharge, to discourage re-wetting of the particle surfaces.

The dryer apparatus as shown in FIG. 1 is comprised of a fixed substantially circular cylindrical stator 11 that is multi-functional and serves as the body/casing of the dryer and houses a rotor 10.

The rotor 10 has the in-feed auger 1 coaxially joined to it and is slowly rotated by a variable speed motor and drive train. The in-feed auger 1 transfers the coal particle feedstock into the dryer and is configured as a quill-drive hollow flight auger. The hollow form of the auger 1 and rotor 10 allows compressed air 8 from an air compressor 8*a* to be admitted to a plenum chamber 7 within the rotor 10. Coal within the auger 1 provides an air seal at the inlet of the dryer to prevent the escape of entrainment air.

As an alternative feed arrangement, the auger 1 may be substituted with a venturi educator to allow material to be drawn by suction from a feed hopper. In this case the educator motive air may be delivered through a modified annular ring nozzle 14 at a speed exceeding the minimum entrainment velocity to ensure that the conveyed material does not fall out of entrainment.

The rotor 10 is fabricated to have a smooth aerodynamic profile and is provided with an array of tangential ports/nozzles 6 arranged as short, narrow longitudinal slots spaced equi-distantly apart in a ring around the circumference of the rotor 10 at one or more stations along the rotor 10. s The tangential ports/nozzles 6 are provided to discharge high velocity air out into the drying zone 12 as shown in FIG. 2A, where the rotor is substantially centrally aligned within the stator/dryer body 11. Here the primary effect of the air emitted from the nozzles 6 is to assist the rotation of the air entrained flow as it passes down through the dryer.

In an alternative arrangement, shown in FIG. 2B, the stator may be moved laterally into an eccentric position relative to the rotor 10. This alternative arrangement will act in part to assist rotation of the air entrained flow but also induce cyclical turbulence/velocity fluctuations in the rotating particle/air stream.

In use the rotor 10 is rotated, using a turning motor, at a suitable rate to regulate the volume of throughput of the apparatus.

The fixed cylindrical stator 11 has the form of a duct, with an aerodynamic profile, and defines the main duct/route through which the air entrained flow passes through the dryer. The stator 11 also is the casing/ body of the dryer to interconnect the various stages of the apparatus, which include the entrainment air inlet 3, throat 13, stator plenum chamber 4 and radial air nozzle arrays 5. The stator also provides rigidity for correct alignment of the system.

The entrainment air in-feed 3 is comprised of a cylindrical chamber surrounding, but isolated from, the coal in-feed auger 1. The entrainment air in-feed 3 is fabricated with two or more tangential inlet ports shown in FIG. 3 to introduce the entrainment air into the dryer and at the same time induce rotation of the entrainment airflow within the dryer.

The stator plenum chamber 4 is an annular void in the stator casing 11 that is provided to supply compressed air to an array of air nozzles 5. The air nozzles 5 are configured to be turbulence-inducing and are directed radially inwardly into the main duct of the dryer, to emit the air directly towards the central longitudinal axis of the dryer and thus transecting substantially orthogonal to the entrainment flow. The nozzles 5 may be provided in the form of small holes or narrow longitudinal slots as shown in Section A-A. The radial air nozzles may be circumferentially spaced, as illustrated, or irregularly spaced to reduce harmonic oscillation.

The operation of the apparatus shown in FIG. 1 will now be described in further detail.

Entrainment air is provided at high volume and compressed to a pressure above atmospheric pressure. The temperature of the entrainment air supply is nominally at ambient temperature, though it will be somewhat raised only due to the Heat of Compression (adiabatic). Additional heat is normally unnecessary to complete the drying process.

The entrainment air is always rotated during the drying process and the rotation is initiated by the tangential entrainment air inlet ports 3. The rotating entrainment air is discharged from an annular nozzle 14 at high velocity and directed at the coal in-feed auger 1 delivery port to entrain coal particles emerging from the auger 1.

The rotating particle air stream is forced into an annular throat 13 of the main duct of the dryer, with an attendant increase in velocity and drop in pressure. This causes a momentary velocity differential between the entrainment air and entrained particles; conditions for both shearing and evaporation and thereby provides a preliminary drying phase.

On exiting the throat 13, the particle air stream is forced into an annular passage having a greater cross sectional area and a larger diameter than the throat 13. This ensures that particle trajectory path is as long as possible for maximum residence time and, as the air flow slows, induces a momentary velocity differential between the entrainment air and entrained particles resulting in further shearing.

The entrained particle stream then progresses along a helical path following the internal surface of the stator 11 by centrifugal forces. The trajectory of the entrained particle stream passes over the radial nozzle array 5 (fed from compressed air within the stator plenum chamber 4) where a high velocity jets of compressed air cross the entrained particle stream at right angles. This is done for several reasons. In particular: the air jets 5 cause a direct shear effect on the particles; particles are impelled away from the stator 11 internal surface; particles are tumbled in turbulent air; and laminar flow conditions are locally disrupted.

Rotation of the entrainment air and entrained particles is to be maintained at a high enough angular velocity to ensure that coal does not fall out of entrainment, resulting in sedimentation. Adequate rotation is ensured by the tangential air jets 6 emitted from the rotor 10. Following transit through the tangential air jets 6, the entrainment air and entrained particles are encouraged to follow again the stator internal surface to allow both the entrainment air and entrained particles undisturbed helical flight towards the out-feed port 2. In this zone the coal, having a higher density than water vapour or droplets, will occupy the lamina closest to the stator 11 internal surface. Water vapour and droplets will occupy an inner lamina slightly displaced from the stator 11 internal surface.

After transits through the stator 11 and rotor 10 nozzle arrays 5 & 6 of consecutive dryer units or repeatedly through the same unit a significant proportion of the surface water is removed. In trials 97% of surface water may be removed in just a couple of passes. The dry coal fraction of the mix can be separated out from the water vapour/droplet fraction suitably using a variety of commercially available, simple, densitometric separation techniques such as use of a cyclone separator 9.

In summary, as will be appreciated from the fore-going, the drying system of the present invention in essence takes a dilute phase vacuum transport system and modifies it to be able to simultaneously transfer and dry granular material. In vacuum conveying systems the aim is to transfer the material smoothly and efficiently with little attrition and particle disruption. Laminar flow conditions are encouraged. By contrast, in the dryer of the present invention the transport conditions are intentionally disrupted to subject the particles to intense acceleration and to create differential velocity between the entrainment flow and each particle.

The apparatus uses arrays of compressed air nozzles to create chaotic flow conditions but without allowing the particles to fall out of entrainment. Nozzles in-feeding the entrainment air and nozzles on the rotor are arranged tangentially to ensure that the entrainment air stream carrying the particles spins to the outside of the stator chamber, closely hugging the chamber wall. Nozzles in the stator chamber, wall are arranged directed radially inwardly to force the stream away from the chamber wall inducing turbulence. In this way, both the trajectory and relative air-to-coal velocity is constantly and violently changed resulting in water being stripped/sheared off the surface of each entrained particle. Once the surface moisture is removed there are slight differences in Specific Gravity, shape and surface area between the coal particles and water droplets. These differences impose slightly different trajectories on the coal and water droplets which generally then keep them apart within the system so that they may be separated at the out-feed.

The system provides nearly instantaneous drying and without heat input. Furthermore, even though the air input cannot be adjusted (since if it is significantly reduced the coal may fall out of entrainment), the apparatus allows a wide range of output specifications to be met by fitting different configurations of multiple nozzle arrays and variable throughputs can be achieved through adjusting transit time. The apparatus also very usefully allows for continuous flow operation and for substantially instantaneous start-up and shut down, unlike for heating based drying systems.

Figure 4:
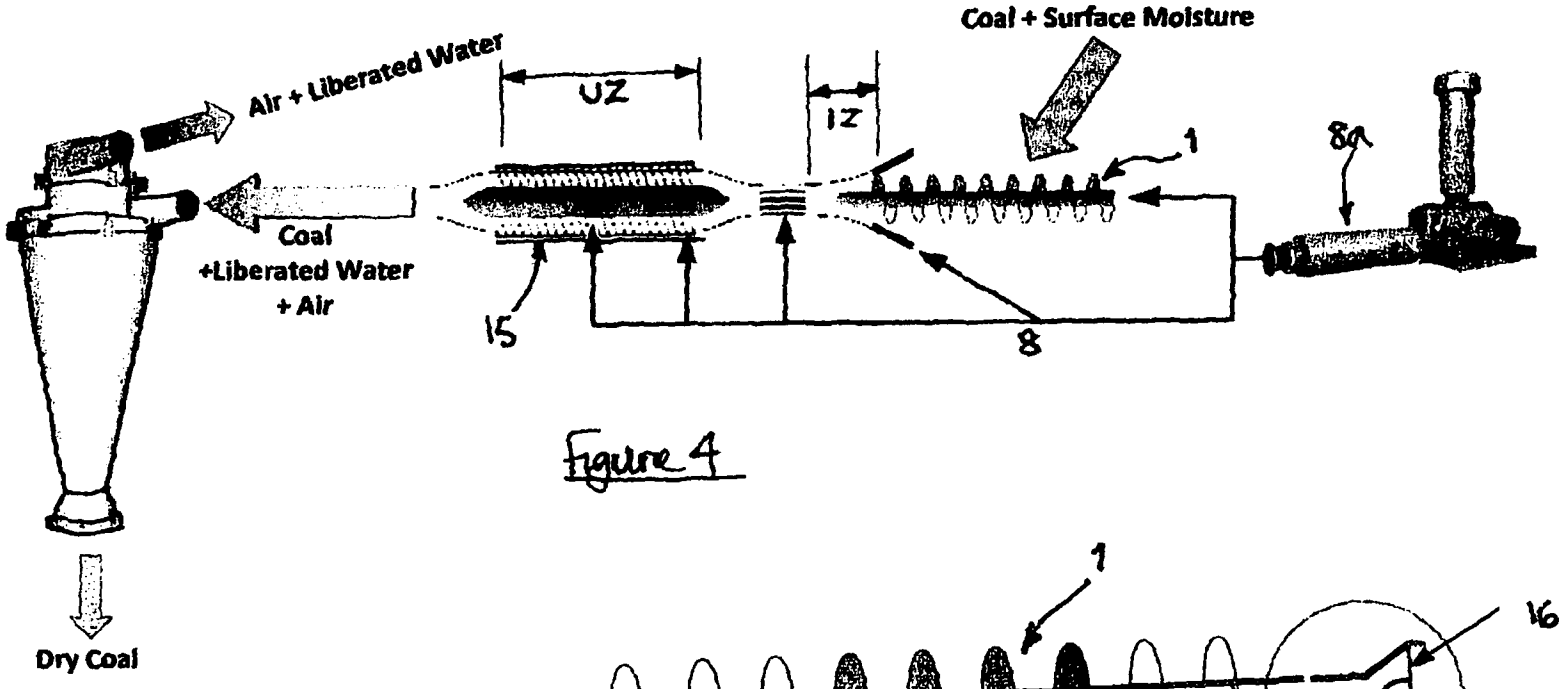
FIG. 4 is a further schematic of the system illustrating a refinement to the system for applying a combination of ultrasound and infrasound to the gas-entrained particle flow.
Figure 5:
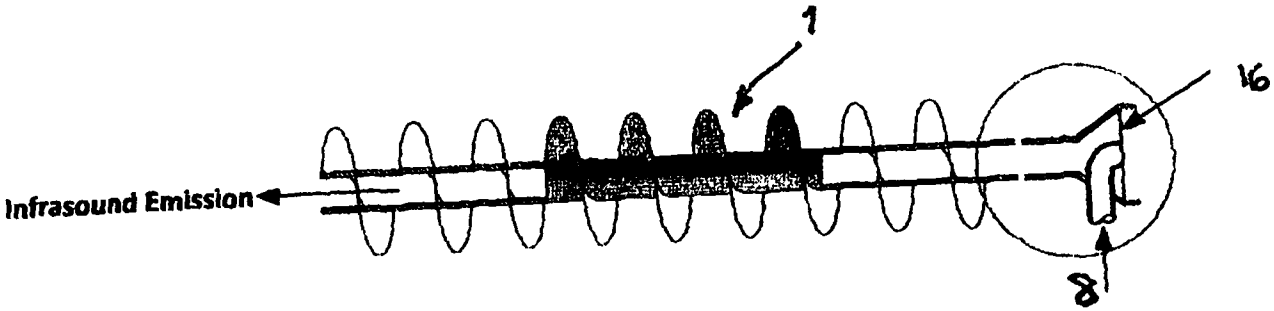
FIG. 5 is a detail view of the infrasound generator showing the diaphragm fitted to the proximal end of the augur.

Turning to FIGS. 4 and 5, the system of those figures is augmented with arrangements for applying ultrasound and for applying low frequency sound or infrasound to the gas-entrained particle flow. In the case of ultrasound, this is generated by a thin annular contact probe 15, eg of steel of the order of 0.025 mm thick, that encircles the stator casing 11 in contact with it forming an ultrasound zone UZ. The ultrasound generated by the probe 15 is transmitted internally by the stator casing 11 and serves to further discourage contact between the coal particles and the inner chamber wall of the stator casing 11 and to further disrupt the flight of coal particles, increasing stripping of surface moisture from the coal particles.

In the case of low frequency sound below 20 kHz or infrasound below 20 Hz, this is generated using a compressed air diaphragm 16 (similar to that used in fog horns/ships sirens etc) at the proximal end of the hollow-flight coal in-feed auger 1. The low frequency sound or infrasound is simply conducted down the centre of the 'quill' of auger 1 to emerge at the point where the coal is entrained by the motive air forming a low frequency sound/infrasound zone IZ. The sound waves help to de-agglomerate the coal particles in the energetic section of the processor where the coal particles depart from the auger screw 1. The high pressure compressed air supply for the low frequency sound or infrasound generation or for the ultrasound generation may come from different respective air compressors or a shared compressor. The compressor may be the same air compressor 8*a* as provides the gas transport for the coal and the moisture stripping turbulence gas. In the latter case preferably the compressed air pressure and flow rate is adjusted in the delivery for each of the different functions.

The invention claimed is:

1. A system for removing surface moisture from granulated coal or other materials in particulate form, the system comprising a dryer, wherein the dryer has:

an in-feed for material particles;

an in-feed for entrainment gas(es), to provide dilute phase gas entrainment of the particles;

turbulence-inducing means configured to subject the flow of gas-entrained particles to turbulence, wherein the turbulence-inducing means comprises a supply of dry gas(es) in use and that delivers the dry gas(es) so as to impinge on/intersect with the gas-entrained particle flow whereby inducing turbulence to strip water from the surface of the entrained particles; and a stator body through which the gas-entrained particles flow in use, wherein the turbulence-inducing means comprises one or more ports in the stator body that delivers high velocity compressed/pressurised dry turbulence-inducing gas(es) inwardly into a main duct to intersect with the gas-entrained particle flow, wherein the one or more ports deliver the turbulence-inducing gas(es) substantially directly radially inwardly and substantially orthogonally to the gas-entrained particle flow.

2. A system as claimed in claim 1, wherein the dryer comprises a rotor within the stator body, the stator body having the form of a tubular main duct.

3. A system as claimed in claim 2, wherein the dryer has an array of ports in the stator body arranged around the rotor.

4. A system as claimed in claim 2 wherein the rotor has a tubular duct therethrough and at least one port to deliver high velocity compressed/pressurised gas(es) outwardly into the main duct to impinge on the gas-entrained particle flow.

5. A system as claimed in claim 4, wherein at least one port of the rotor is configured to deliver the high velocity compressed/pressurised gas(es) outwardly tangentially to the rotor whereby it energises rotation of the gas-entrained particle flow.

6. A system as claimed in claim 4, wherein the rotor has an array of ports arranged around the rotor.

7. A system as claimed in claim 1, wherein the dryer is configured to operate to rotate the gas-entrained particle flow as it passes therethrough and the entrainment gas in-feed comprises one or more ports that are substantially tangential to the longitudinal axis of the dryer to initiate rotation of the flow of gas-entrained particles.

8. A system as claimed in claim 2, wherein the stator body is laterally offset relative to the rotor, having the longitudinal axis of the stator body offset and parallel to the axis of the rotor.

9. A system as claimed in claim 1, wherein the in-feed for the material particles comprises a venturi educator.

10. A system as claimed in claim 1, wherein the in-feed for the material particles comprises an in-feed auger.

11. A system as claimed in claim 2, wherein the rotor is integral with or coupled to the particulate material in-feed auger to rotate therewith.

12. A system as claimed in claim 11, wherein the auger is a quill drive hollow flight auger.

13. A system as claimed in claim 2, wherein the main duct of the dryer through which the gas-entrained particles flow has, proximate the in-feed end, a throat to cause an increase in flow velocity and drop in pressure with a corresponding velocity differential between the entrainment air and entrained particles to induce stripping of water.

14. A system as claimed in claim 13, wherein the main duct of the dryer exiting the throat broadens to a greater cross sectional area and a larger diameter than the throat, for slowing flow and inducing a momentary velocity differential between the entrainment air and entrained particles resulting in further shearing.

15. A system as claimed in claim 1, wherein the system further comprises an ultrasound generator configured to apply ultrasound to the gas-entrained particle flow.

16. A system as claimed in claim 2, wherein the system further comprises an ultrasound generator configured to apply ultrasound to the gas-entrained particle flow, and wherein the ultrasound generator is an annular contact probe that encircles the stator body in contact therewith.

17. A system as claimed in claim 10, wherein the system further comprises a generator of low frequency sound below 20 kHz or infrasound.

18. A system as claimed in claim 17, wherein the generator of low frequency sound or infrasound is configured to apply sound waves to material particles where they meet the entrainment gas(es).

19. A system as claimed in claim 17, wherein the low frequency sound or infrasound generator is positioned to direct sound waves towards the exit of the in-feed auger.

20. A system as claimed in claim 17, wherein the low frequency sound or infrasound generator comprises a diaphragm that is driven by compressed air.

21. A process for removing surface moisture from granulated coal or other materials in particulate form, the process comprising feeding the material particles and entrainment gas(es) into a duct to provide dilute phase gas entrainment of the particle, introducing dry gas(es) to impinge on the flow of gas-entrained particles to cause turbulence in the flow of gas-entrained particles to strip water from the surface of the entrained particles, wherein the dry gas(es) are introduced radially inwardly and substantially orthogonally to the flow of gas-entrained particles.

* * * * *